US011833708B2

(12) United States Patent
Benner

(10) Patent No.: US 11,833,708 B2
(45) Date of Patent: Dec. 5, 2023

(54) SAWMILL CLAMP EXTENSION DEVICE

(71) Applicant: David Vance Benner, Warren, ME (US)

(72) Inventor: David Vance Benner, Warren, ME (US)

( * ) Notice: Subject to any disclaimer, the term of this patent is extended or adjusted under 35 U.S.C. 154(b) by 318 days.

(21) Appl. No.: 17/064,629

(22) Filed: Oct. 7, 2020

(65) Prior Publication Data

US 2021/0101305 A1 Apr. 8, 2021

Related U.S. Application Data

(60) Provisional application No. 62/911,472, filed on Oct. 7, 2019.

(51) Int. Cl.
*B27B 29/02* (2006.01)
*B27B 31/06* (2006.01)
*B27B 15/02* (2006.01)

(52) U.S. Cl.
CPC ..... *B27B 29/02* (2013.01); *B27B 15/02* (2013.01); *B27B 31/06* (2013.01)

(58) Field of Classification Search
CPC ..... B27B 31/06; B27B 15/02; B27B 29/02; B25B 5/00; B25B 5/12; B25B 5/16; B23Q 3/00; B23Q 3/005; B23Q 3/06
USPC ..... 83/375; 144/287
See application file for complete search history.

(56) References Cited

U.S. PATENT DOCUMENTS 731,919 A * 6/1903 Larson ..... B27G 5/026 83/762
1,864,840 A * 6/1932 Lehner ..... B23Q 1/72 144/287
3,397,722 A * 8/1968 Long ..... B27G 5/026 83/762
3,935,779 A * 2/1976 Hildebrandt ..... B27G 5/026 83/762
4,613,120 A * 9/1986 Kozar ..... B25B 5/16 269/282
5,261,304 A * 11/1993 Stollenwerk ..... B23D 59/00 83/410.8
5,363,893 A * 11/1994 Grochowicz ..... B23Q 1/74 108/73
5,472,029 A * 12/1995 Ketch ..... B23Q 9/0042 144/144.1
8,544,372 B2 * 10/2013 Economaki ..... B27B 25/00 144/287
2005/0161115 A1 * 7/2005 Huang ..... B27B 21/00 144/253.1
2014/0318341 A1 * 10/2014 Fait ..... B27B 27/08 83/477

FOREIGN PATENT DOCUMENTS

DE 2950034 A1 * 7/1981 ..... B25B 5/003
DE 2530776 A1 * 7/2023 ..... B25B 1/24
GB 2210580 A * 6/1989 ..... B23Q 9/0042

* cited by examiner

*Primary Examiner* — Laura M Lee

(57) ABSTRACT

A clamp extension device adapted to extend the size range of materials that may be cut by a sawmill, the device being removably attachable to an existing clamp on the sawmill.

3 Claims, 5 Drawing Sheets

SAWMILL CLAMP EXTENSION DEVICE

BACKGROUND INFORMATION

Field of the Invention

The invention relates to sawmills and, more particularly, devices that hold materials in the proper position as they are being cut.

Discussion of Prior Art

Sawmills are devices that cut materials, such as logs and lumber, into usable pieces, such as useable pieces of lumber. Sawmills come in a variety of forms, from large industrial facilities to relatively small and portable machines, with the setup and design of the various sawmills varying from one to the next. One common setup, particularly with smaller portable models, includes the use of a steel bed, upon which the logs are placed and secured, with a motorized saw, such as a band saw, that moves along the bed to cut the log horizontally. Typically, the logs are secured in place on the bed by having one or more support posts on one side of the bed with an adjustable clamp on the other side, thereby allowing a user to secure various sizes of materials.

These types of sawmills are limited only in the size of the bed and the width of the saw. However, in many cases the width of the saw is greater than the maximum width that the adjustable clamp is able to support. As a result, the clamp unnecessarily limits the maximum width of lumber that may be cut by the sawmill.

What is needed, therefore, is a clamp extension device that allows a user to secure larger logs so as to take full advantage of the sawmill.

BRIEF SUMMARY OF THE INVENTION

The invention is clamp extension device that is attachable to an existing clamp on a sawmill bed that enables the sawmill to cut wider materials, and in particular wider logs and/or pieces of lumber.

The clamp extension device includes a base plate having clamp securing mechanisms on one end and a clamp member on an opposite end. The clamp securing mechanisms fit around and secure to the conventional clamp. The clamp member replaces the conventional clamp and secures the materials on one side of the sawmill against a support post on the opposite side of the sawmill's bed.

The device is quick and easy to use, with a user needing only to place the device around the clamp and tighten the securing mechanisms, and enables a user to cut materials that are as wide as the sawmill's blade.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
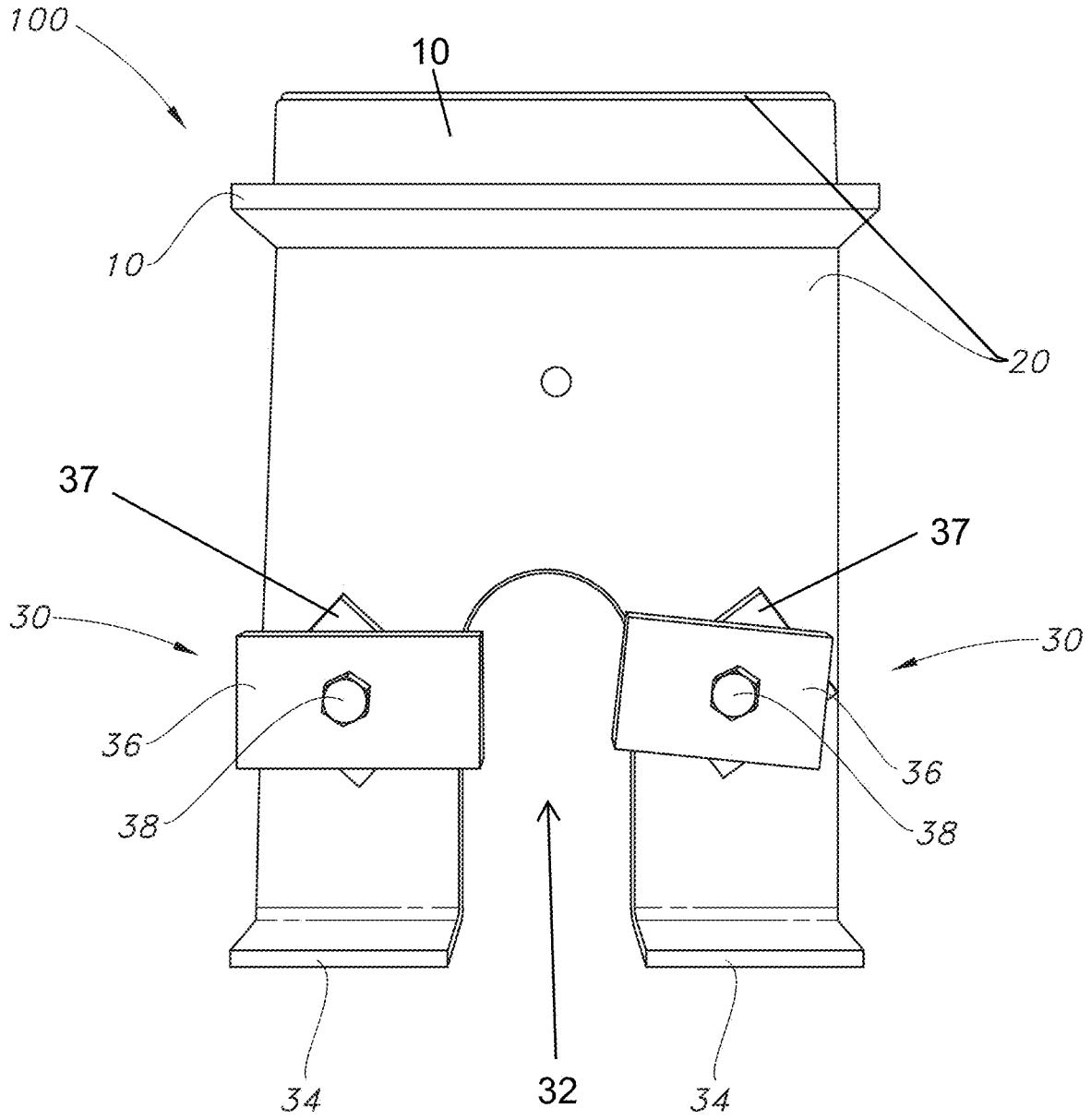
FIG. 1 is a top view of the device according to the invention with the clamp extension mechanism in a locked position.
Figure 2:
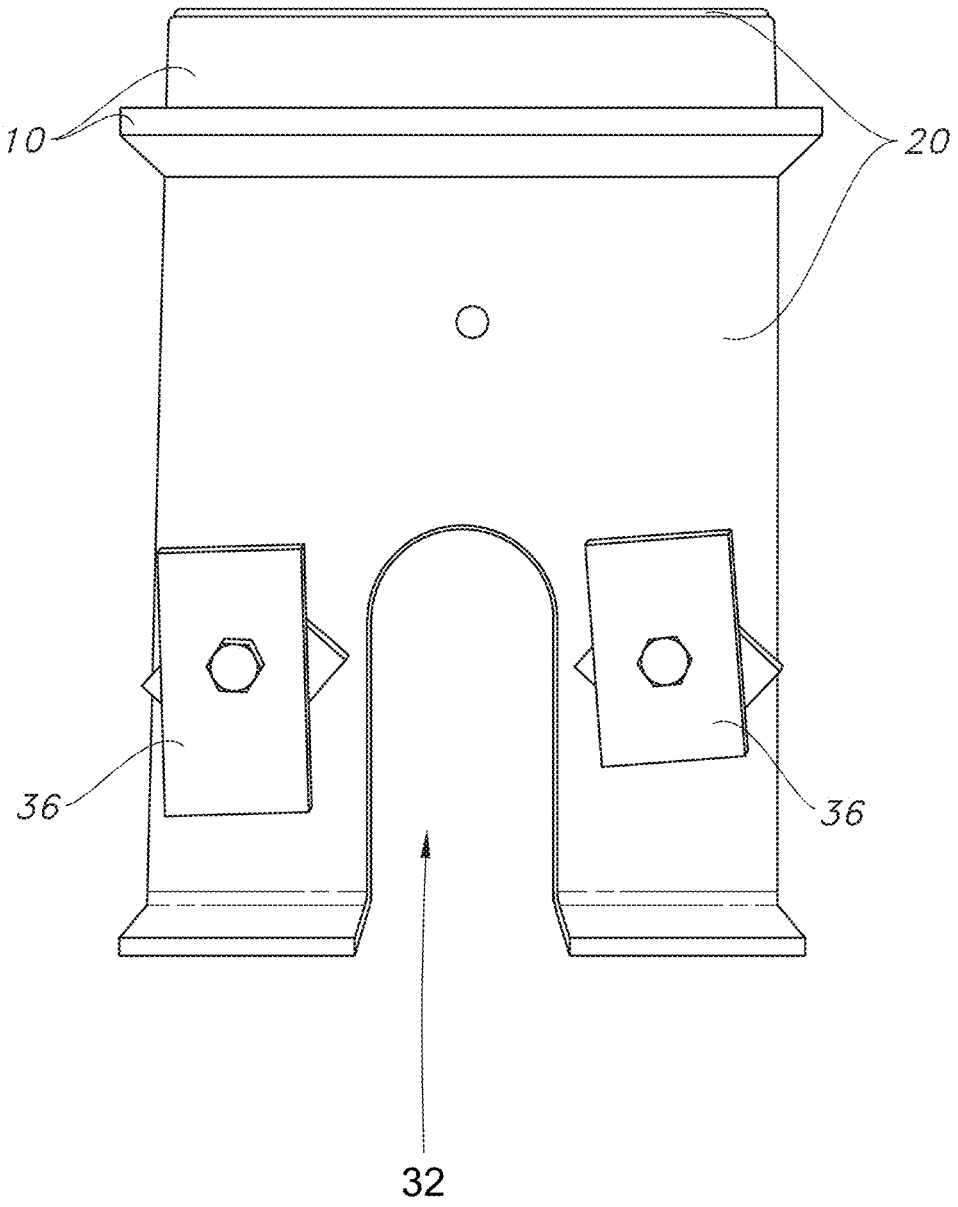
FIG. 2 is a top view of the device with the clamp extension mechanism in the unlocked/open position.
Figure 3:
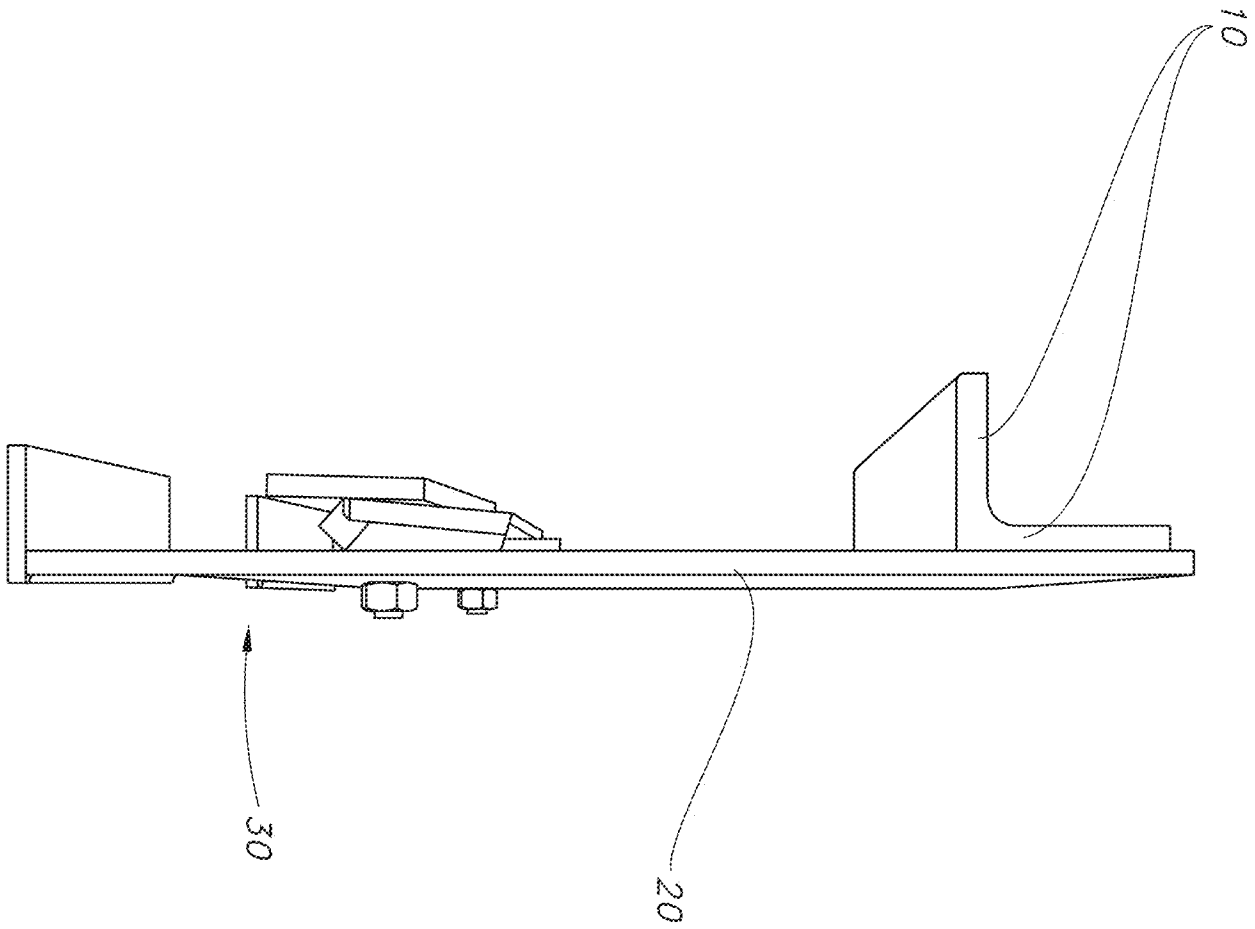
FIG. 3 is a side view of device.
Figure 4:
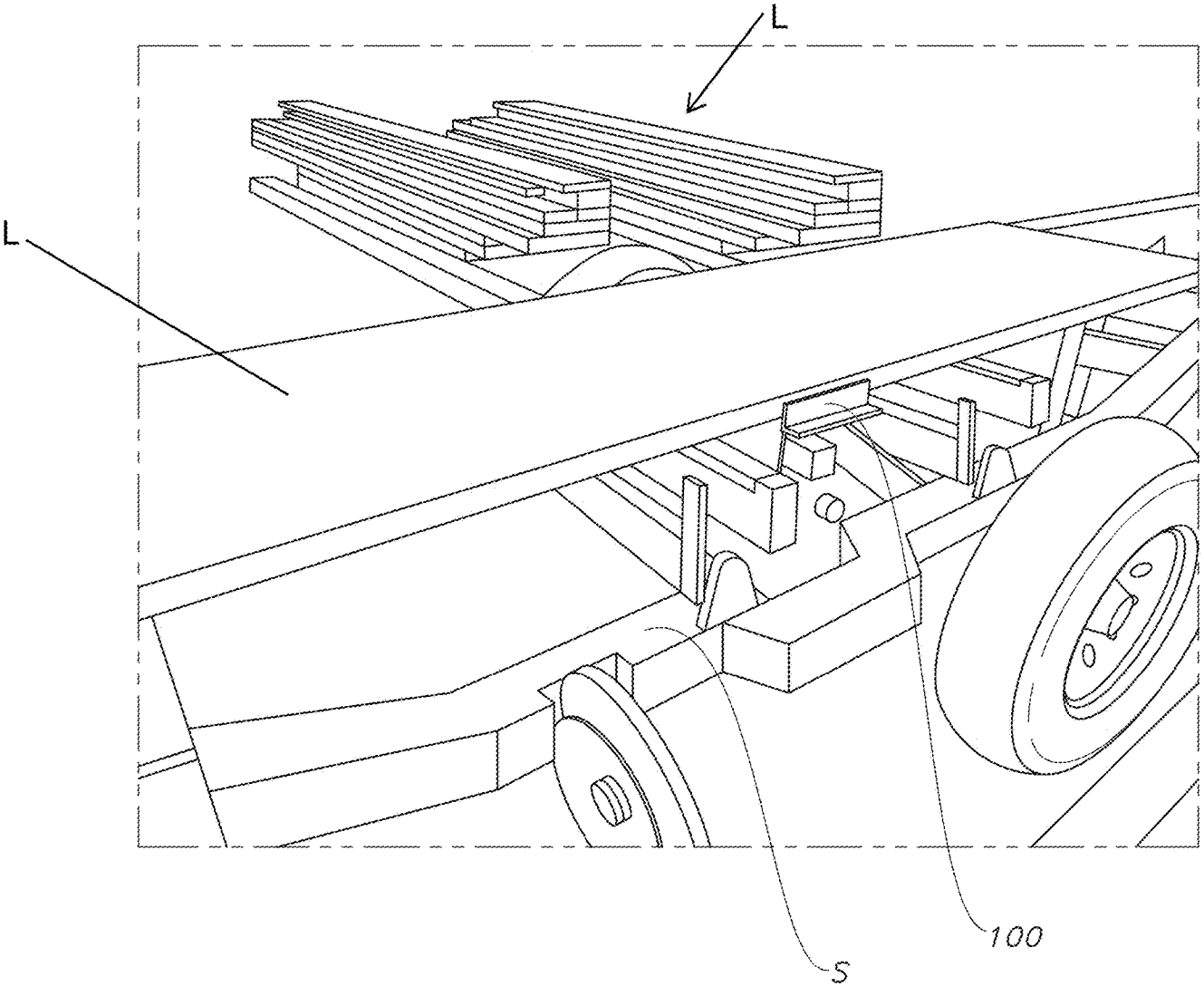
FIG. 4 is a perspective view of a portable saw mill using the device to secure a board.
Figure 5:
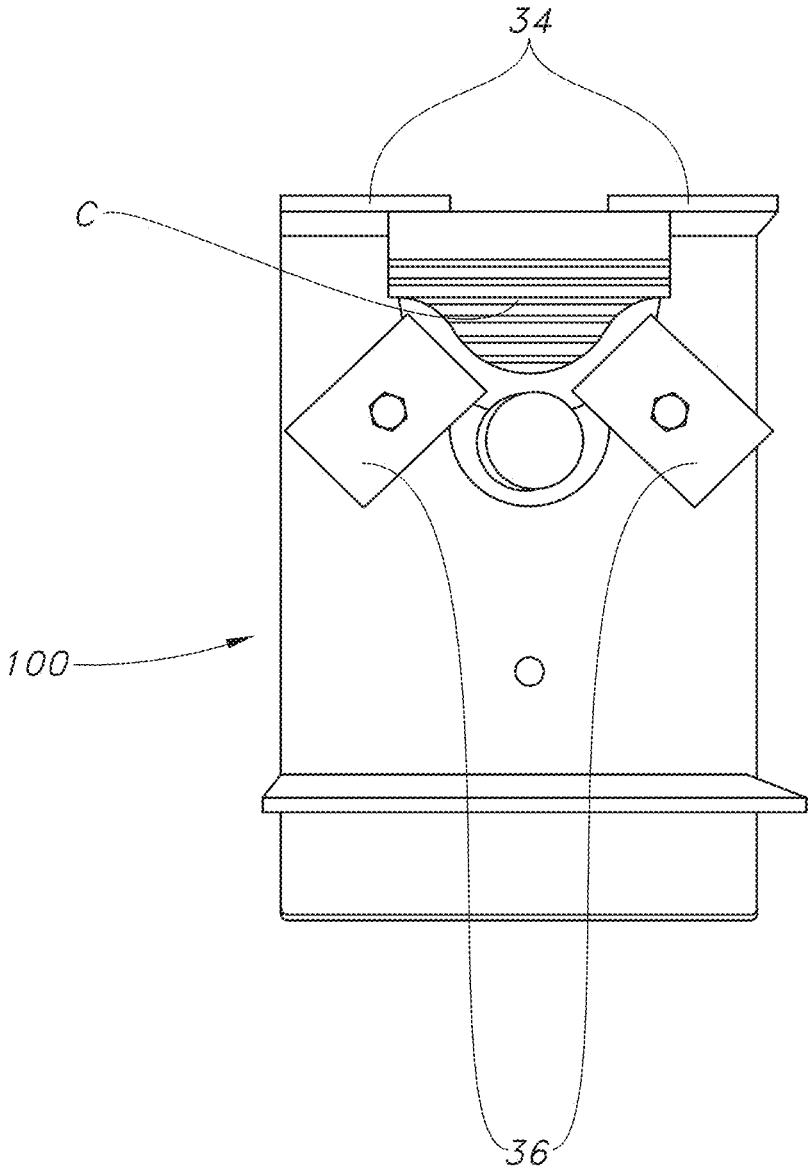
FIG. 5 is top view of the device secured to a clamp on a portable saw mill.

FIGS. 1-3 illustrate the clamp extension device 100 according to the invention and FIGS. 4 and 5 illustrate the manner in which the clamp extension device 100 is adapted to attach to a sawmill S in order to extend the size of materials, such as logs and lumber L, that the sawmill S may cut. The clamp extension device 100 is conveniently attachable to and removable from a conventional existing clamp C on the sawmill S and is generally designed to allow the sawmill to cut materials that are as wide as the sawmill's blade.

The clamp extension device 100 includes a clamp member 10, a base plate 20, and clamp attachment mechanisms 30. The clamp attachment mechanisms 30 secure the clamp extension device 100 to the existing clamp C on a sawmill S, such that the clamping action occurs in the same general location on the materials as was intended with the original design of the sawmill S.

The base plate 20 has a length that is a suitable to secure materials that are approximately as wide as the conventional blade. For example, if the blade is 8 inches wider than the conventional clamp the base plate may have a width of 10 inches. The clamp member 10 has a conventional clamping effect of clamping the log or lumber in the desired location on the sawmill S.

The clamp attachment mechanism 30 is designed to quickly and securely attach the clamp extension device 100 to the existing clamp C. It includes an opening 32 for insertion around the original clamp C, securing ends 34 for insertion over a back end of the clamp C, and securing arms 36 that are moveable between a first position that is open and not secured to the clamp C and a second position that is closed and secured to the clamp C. Turn buffers 37 may be fixed using conventional means, for example by welding, to the base plate 20. Tightening devices 38, which may simply be threaded fasteners such as conventional bolts, may be loosened or tightened to allow the securing arms 36 to move between positions to secure and release the device 100 to the clamp C.

The base plate 20 may itself be adjustable in length, or it may be custom designed to a length that matches the difference in width between the original clamp and the saw blade, or it may simply be long enough create an extension that is likely to be long enough to cover a gap between the original clamp C and the blade. Most conventional clamps are adjustable and as a result providing a clamp extension device that creates a clamp that extends beyond the width of the blade is not a large concern as the original clamp to which the extension device 100 is attached may be adjusted inward.

In the embodiment shown the clamp member 10 is a sturdy L-shaped member that is sufficiently sized and strengthened to hold a log in the desired location. It may be attached to the base plate using a number of conventional techniques, for example, it may be welded to the base plate, attached with fasteners such as threated fasteners, or it may formed as an integral part of the base plate 20.

While the materials and specific dimensions and construction may vary within the scope of the disclosed design, the following is one specific embodiment that is particularly advantageous. The base plate 20 may be approximately between 11 and 12 inches in length and approximately 8 inches in width and made of a type of iron. The clamp member 10 may be an approximately 2 inch by 1 and ¾ inch piece of iron bent at a 90 degree angle with a width that reaches across the width of the base plate 20 and that is welded to the base plate 20. The opening 32 may be approximately 2¼ inches in width, and the securing arms 36 may be pieces of angled iron measuring approximately 1⅜ inch by 2¾ inch by ¼ inch and be welded to the base plate. The turn buffers 37 may be 1¾ inch×1¾ inch×½ inch. The turn buffers 37 may be welded to the base plate, while the tightening devices 32 may a conventional bolt that 1½×⅜ and a ⅜ nut that extend through the arms 36, turn buffers 37, and base plate 20.

While the clamp extension device is suitable for use with a wide array of devices, it is particularly advantageous with portable sawmills, such as those made by Woodmizer, for example, the Woodmizer It40 Wide.

It is understood that the embodiments described herein are merely illustrative of the present invention. Variations in the construction of the clamp extension device may be contemplated by one skilled in the art without limiting the intended scope of the invention herein disclosed and as defined by the following claims.

What is claimed is:

1. A device that is adapted to attach to a clamp on a sawmill, the device comprising:

a base plate having a first end that has a clamp member and a second end that includes a slot that is configured to receive a portion of the clamp, the slot extending through the base plate from an edge of the second end, the second end further including securing ends, one of said securing ends on either side of the slot and extending from the surface of the base plate in a vertical direction substantially parallel to the clamp member;

one or more securing arms pivotally coupled to the base plate between the clamp member and the securing ends such that the one or more securing arms pivot from a closed position where the clamp is secured between the one or more securing arms and the securing ends to an open position where the clamp is unsecured and removable from the device; and wherein the clamp member, the one of more securing arms and the securing ends extend in the same vertical direction from the surface of the base plate, the clamp member extending further away from the surface of the base plate that the securing ends in the vertical direction.

2. The device of claim 1, wherein the one or more securing arms include tightening devices that are configured to hold the one or more securing arms in either the open position or the closed position.

3. The device of claim 1, wherein the clamp member is L-shaped.

* * * * *